US007308922B2

(12) United States Patent
Stein

(10) Patent No.: US 7,308,922 B2
(45) Date of Patent: Dec. 18, 2007

(54) KEY LOCATOR

(75) Inventor: Sandra Stein, West Hills, CA (US)

(73) Assignee: Alexx, Inc., West Hills, CA (US)

( * ) Notice: Subject to any disclaimer, the term of this patent is extended or adjusted under 35 U.S.C. 154(b) by 205 days.

(21) Appl. No.: 10/919,494

(22) Filed: Aug. 17, 2004

(65) Prior Publication Data

US 2006/0037681 A1 Feb. 23, 2006

(51) Int. Cl.
*A45C 11/32* (2006.01)

(52) U.S. Cl. ..... 150/106; 24/3.8; 70/456; 70/459

(58) Field of Classification Search ..... 150/106; 24/3.6; 70/456, 459; D3/207.211; 63/1.1, 63/1.2, 12, 43
See application file for complete search history.

(56) References Cited

U.S. PATENT DOCUMENTS 1,106,388 A * 8/1914 Juergens ..... 63/14.8
1,165,882 A * 12/1915 Killion ..... 70/459
2,117,989 A * 5/1938 Ryan ..... 150/106
2,218,932 A * 10/1940 Collins ..... 70/456 R
2,224,972 A * 12/1940 Long, Jr. et al. ..... 24/3.6
2,250,328 A * 7/1941 Daniels ..... 24/3.6
D178,482 S 8/1956 Bacon
3,016,224 A * 1/1962 Hall ..... 248/205.3
3,071,938 A * 1/1963 Davidson ..... 63/13
3,670,524 A * 6/1972 Korwin ..... 63/18
3,707,742 A * 1/1973 Justice et al. ..... 24/377
3,934,317 A 1/1976 Langwell
4,004,325 A 1/1977 Hubachek
4,113,156 A 9/1978 Brito
4,201,259 A 5/1980 Alsdorf
4,221,118 A * 9/1980 Chicckine ..... 63/13
4,226,105 A 10/1980 Wehrman
4,282,733 A * 8/1981 Schmitt (Johnston) .... 70/456 R
D262,498 S 1/1982 Beilis
4,319,384 A 3/1982 Horne
4,407,148 A 10/1983 Rousseau
4,430,778 A 2/1984 Sander
4,516,418 A 5/1985 Cuttler
4,523,443 A 6/1985 Momemers (Continued)

FOREIGN PATENT DOCUMENTS

FR 2606258 A1 * 5/1988

(Continued)

OTHER PUBLICATIONS

Missiissippi Quarter from the United States Mint, issued 2002.*

*Primary Examiner*—Sue A. Weaver
(74) *Attorney, Agent, or Firm*—Jones Day; Brett Lovejoy

(57) ABSTRACT

A key locator includes first and second members. The first member has opposed ends and an intermediate u-shaped region. One of the ends of the first member comprises a hook for engaging the second member which includes a clasp while the other end comprises an enlarged portion for fixing an ornament thereto. The arrangement is suitable for hanging at the open top of a bag-like device such as a purse, backpack or briefcase whereby the ornament is displayed at the same time that the keys are readily accessible without undue fishing efforts.

19 Claims, 2 Drawing Sheets

U.S. PATENT DOCUMENTS 4,576,839 A * 3/1986 Parren ..... 428/13
4,587,818 A 5/1986 Griffin
D285,989 S 10/1986 MacDonald
D288,984 S 3/1987 Scheurer et al.
4,665,594 A 5/1987 Wagner
D308,294 S 6/1990 Krassner
D309,830 S 8/1990 Kraus
D311,451 S 10/1990 Chan
D312,172 S 11/1990 Ambrosio
4,976,124 A * 12/1990 Sanders ..... 70/458
5,048,310 A * 9/1991 Riley ..... 63/13
5,078,484 A * 1/1992 Vaughn ..... 351/51
5,173,999 A 12/1992 Welk et al.
D341,940 S 12/1993 MacDonald
5,312,029 A 5/1994 Tuber
D352,821 S 11/1994 Stillwagon
5,359,870 A 11/1994 Reutlinger
D353,261 S 12/1994 Fort et al.
D357,350 S 4/1995 Stillwagon
D366,359 S 1/1996 Riedl
D371,325 S 7/1996 Fritsche
5,535,797 A * 7/1996 Martindale ..... 150/111
5,551,269 A * 9/1996 Lewinstein et al. ..... 70/459
D383,304 S 9/1997 Van Osch
D385,415 S 10/1997 Turbide
D392,797 S 3/1998 Kampe
5,729,870 A 3/1998 Sharp
5,768,915 A * 6/1998 Crumrine et al. ..... 63/29.1
D403,500 S 1/1999 Winter
D403,501 S 1/1999 Winter
D403,502 S 1/1999 Winter
5,983,686 A * 11/1999 Lee ..... 70/456 R
D440,399 S 4/2001 DeRouen et al.
D441,184 S 5/2001 Haapala
6,318,610 B1 11/2001 Doherty
6,334,239 B1 1/2002 Kraut
D468,091 S 1/2003 Tipton
6,536,081 B2 3/2003 Allen et al.
6,591,646 B1 7/2003 Huang
D478,719 S 8/2003 Mercuri
6,606,769 B1 8/2003 Harris
D479,768 S 9/2003 Macevicz
D484,306 S 12/2003 Lau
6,772,614 B1 * 8/2004 Cheng ..... 70/456 R
6,843,086 B2 1/2005 Fitch
6,870,483 B1 3/2005 Davis
D503,850 S 4/2005 Staab
D504,222 S 4/2005 Kieffer
6,928,943 B1 8/2005 Neubauer
D510,185 S 10/2005 Chan
7,021,852 B1 4/2006 Turner, III et al.
2003/0200687 A1 10/2003 Wolfe
2003/0200779 A1 10/2003 Fitch
2004/0020813 A1 * 2/2004 Moeller et al. ..... 206/425
2005/0208848 A1 9/2005 Grossman
2005/0257867 A1 11/2005 Vazin
2006/0048343 A1 3/2006 Sinon
2006/0090302 A1 5/2006 Colby

FOREIGN PATENT DOCUMENTS

GB 2180137 A * 3/1987
GB 2274236 A * 7/1994
GB 2275173 A * 8/1994
JP 2003 174913 A * 6/2007

* cited by examiner

FIG. 1A
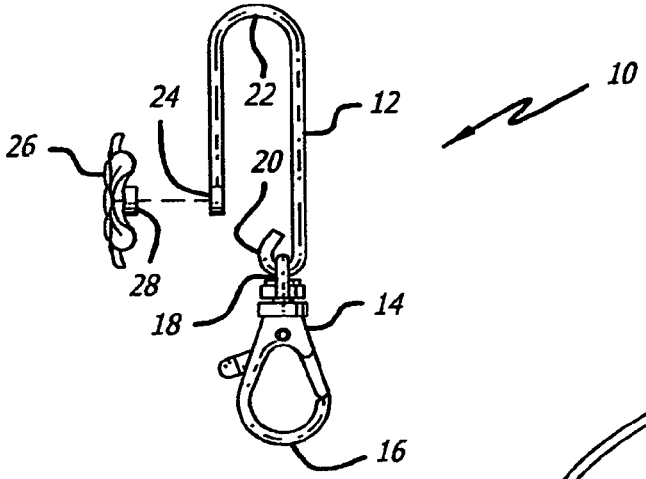
FIG. 1B
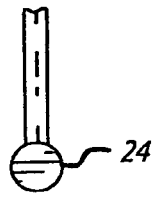
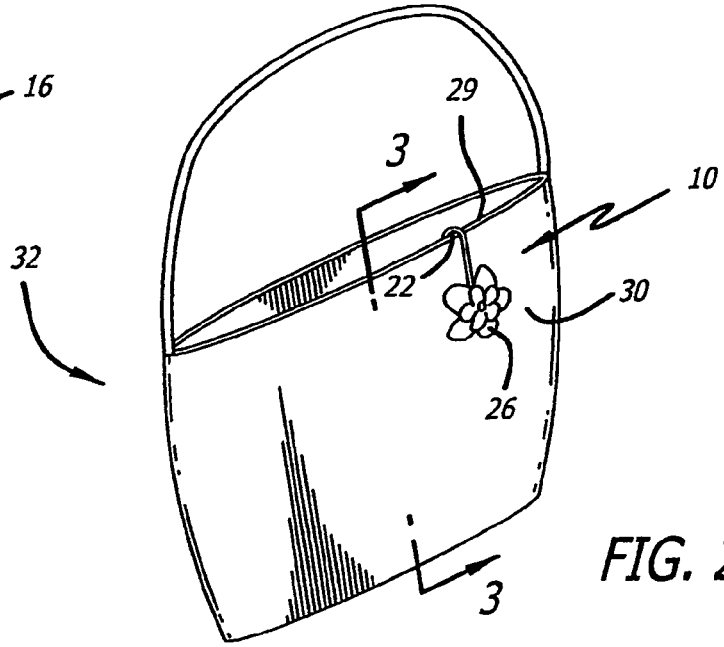
FIG. 2
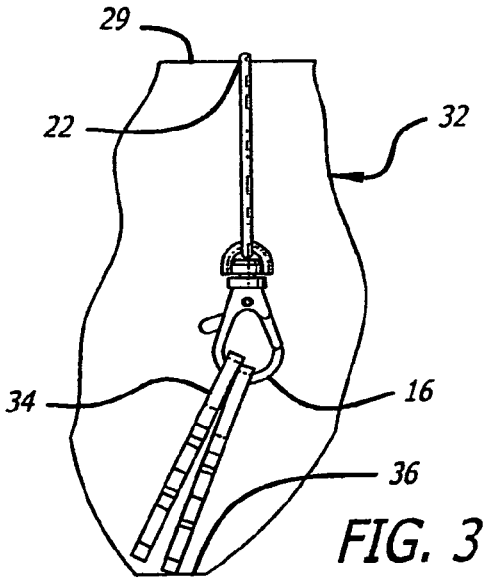
FIG. 3

KEY LOCATOR

BACKGROUND

1. Field of the Invention

The present invention relates to key holders. More particularly, this invention pertains to a key holder that is especially adapted to facilitate the ready location of keys in a purse, backpack, briefcase or like bag.

2. Brief Description of the Prior Art

A common and popular type of purse or like bag has a top that includes at least a region that is upwardly open in use. Often this type of bag is rather deep, permitting the owner-user to store a variety of items. Further, such depth is generally considered fashionable.

A known drawback of the above-described purse or like bag configuration resides in the difficulty of readily retrieving keys, or a group thereof gathered on a key chain, from its interior. This can lead to the frustration of the owner-user and to others. For example, the difficulty of locating car keys at the bottom of a purse can cause significant delay in vacating a parking space.

SUMMARY OF THE INVENTION

The present invention addresses the preceding and other shortcomings of the prior art by providing a key locator. Such key locator includes a first member having opposed end portions.

The member incorporates a u-shaped region intermediate the end portions. A second member includes a clasp for selectively retaining at least one key. The first and second members are engaged to one another.

The preceding and other features of the invention will become further apparent from the detailed description that follows. Such description is accompanied by a set of drawing figures. Numerals of the drawing figures correspond to numerals of the written description with like numerals referring to like features throughout both the written description and the drawing figures.

BRIEF DESCRIPTION OF THE DRAWINGS

FIG. 2 is a perspective view of the key locator of the invention in use; and FIG. 3 is a cross-sectional view of the key locator of the invention in use taken at line 3-3 of FIG. 2.

DETAILED DESCRIPTION OF THE PREFERRED EMBODIMENT

Figure 1C:
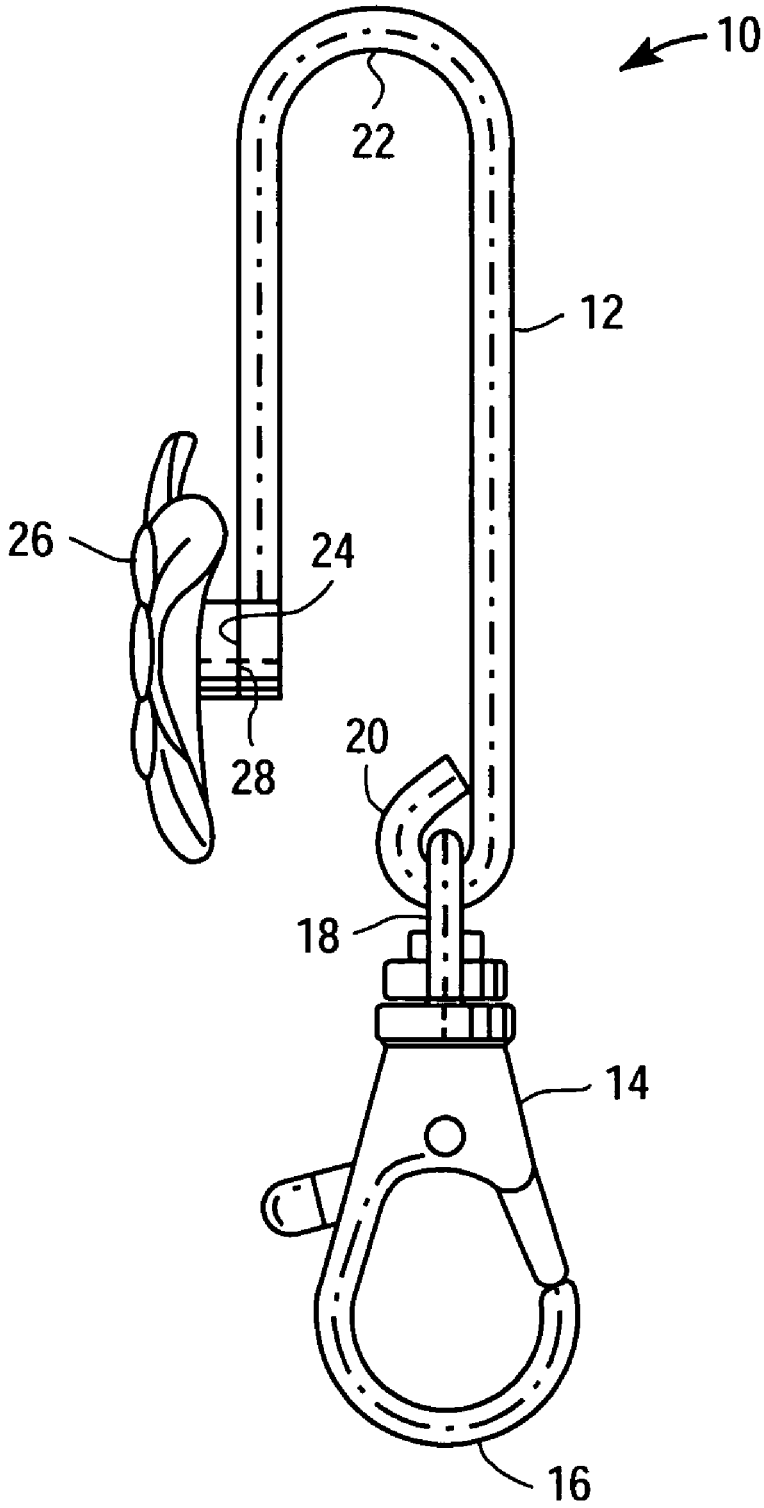
FIGS. 1(*a*) and 1(*b*) are a front elevation view of the key locator of the invention and a partial planar view of the ornament mounting pad thereof respectively, and FIG. 1(*c*) is a front elevation view of the key locator of the invention with the decorative element shown attached.

Turning now to the drawings, FIG. 1(*a*) is a front elevation view of the key locator 10 of the invention. The key locator 10 comprises interlocking first and second members 12 and 14 respectively. Each of the first and second members 12, 14 is preferably of steel or other metal although plastic or other rigid elastomeric material may be employed.

The second member 14 includes a clasp 16 that is preferably rotatably engaged to an inverted u-shaped element 18. The u-shaped element 18 is arranged to engage a hook 20 at one end of the first member 12 to provide flexible engagement of the members 12 and 14.

The first member 12 includes a u-shaped interior region 22. Its opposed end, as shown clearly in FIG. 1(*b*), comprises an enlarged region 24 that serves as an ornament mounting pad for affixation of a decorative ornament 26. The ornament 26, comprising a flower-like shape as shown in the drawings but not limited thereto, is arranged to face away from the interior of the first member 12 with its back portion 28 preferably fixed to the enlarged region 24 of the member by solder or the like.

FIG. 2 is a perspective view of the key locator 10 of the invention in use. In FIG. 2, the key locator 10 is hung from the upper edge 29 of a side panel 30 of a bag-like purse 32 with the u-shaped region 22 overhanging the side panel 30 so that the face of the ornament 26 is exposed. This provides the user with an attractive adjunct to the purse 32 that serves the additional function of readily locating the key locator 10.

FIG. 3 is a cross-sectional view of the key locator of the invention in use taken at line 3-3 of FIG. 2. Keys 34, secured by the clasp 16 of the secodn member 14, are seen to lie near or at the bottom 36 of the bag-like purse 32, somewhat suspended from the upper edge 29 of the side panel 30. The u-shaped interior region 22 of the first member 12 of the key locator 10, as mentioned with reference to the preceding figure, is draped or hung over the upper edge 29 to create the suspension effect. The altitude of the bottom of the key locator 10 and keys 34 will depend upon the length of the key locator 10 relative to the depth of the side panel 30 of the bag-like purse 32. However, regardless of the precise altitude of the keys 34 within the purse 32, they may be readily located due to the visible presence of the ornament 26.

Thus, it can be seen that the present invention provides a key locator especially suitable for use with a purse, backpack, briefcase or other bag-like device. By employing the key locator of the invention in conjunction with such a device, one may find keys stored within without delay. Further, by providing a decorative ornament for indicating the location of the key locator, the appearance of the bag is enhanced.

While this invention has been described with reference to its presently preferred embodiment, it is not limited thereto. Rather the invention is limited only insofar as it is defined by the following set of patent claims and includes within its scope all equivalents thereof.

What is claimed is:

1. A key locator comprising, in combination:

a) a bent rod-shaped first member having a first end portion and a second end portion; and b) a second member including a closed-form clasp for selectively retaining at least one key; wherein said first end portion and said second end portion are opposed to each other;

said bent rod-shaped first member incorporates a u-shaped region intermediate said first end portion and said second end portion;

said first end portion and said second end portion are not urged against each other and are configured to allow said u-shaped region to hang from an edge;

said bent rod-shaped first member and said second member are substantially permanently and flexibly engaged to one another via a single hook at said first end portion of said bent rod-shaped first member; and said closed-form clasp is rotatably fixed to a u-shaped element of said second member, wherein the u-shaped element is substantially permanently and flexibly engaged to said single hook at said first end portion of said bent rod-shaped first member.

2. A key locator as defined in claim 1 further including an ornament directly and permanently fixed to said second end portion of said bent rod-shaped first member so that a first face of the ornament is exposed and so that the ornament is arranged to face away from an interior of said bent rod-shaped first member, wherein the ornament provides the function of readily locating the key locator on said edge and wherein the ornament provides the function of an attractive adjunct.

3. A key locator as defined in claim 2 wherein said second end portion of said bent rod-shaped first member comprises an enlarged portion for affixation of said ornament.

4. A key locator as defined in claim 3 wherein said ornament comprises a flower shape.

5. A key locator as defined in claim 3 wherein a back portion of said ornament is soldered onto said enlarged portion.

6. The key locator as defined in claim 1 wherein said bent rod-shaped first member and said second member are each made of a material selected from the group consisting of metal, steel, and plastic.

7. A key locator as defined in claim 1, wherein the edge is an upper edge of a side panel of a bag-like purse.

8. A key locator as defined in claim 7, wherein the bag-like purse is a purse, a backpack, or a briefcase.

9. A key locator as defined in claim 1, wherein said bent rod-shaped first member and said second member are configured so that when the bent rod-shaped first member is retrieved from the edge, the second member is necessarily retrieved.

10. A two-member apparatus comprising a bent rod-shaped first member and a second member, wherein (i) said bent rod-shaped first member has a first end portion and a second end portion, wherein said first end portion and said second end portion are opposed to each other;

(ii) said bent rod-shaped first member incorporates a u-shaped region intermediate said first end portion and said second end portion, wherein said first end portion and said second end portion are not urged against each other and are configured to allow said u-shaped region to hang from an edge;

(iii) said bent rod-shaped first member and said second member are substantially permanently and flexibly engaged to one another via a single hook at said first end portion of said bent rod-shaped first member; and (iv) an ornament is directly and permanently fixed to a said second portion so that a face of the ornament is exposed and wherein the ornament provides the function of readily locating the two-member apparatus on the edge and wherein the ornament provides the function of serving as an attractive adjunct; and wherein said second member comprises a closed-form clasp that is rotatably fixed to a u-shaped element and wherein said u-shaped element engages said single hook at said first end portion of said bent rod-shaped first member, wherein the closed-form clasp is configured for selectively holding keys.

11. The two-member apparatus of claim 10, wherein said ornament comprises a flower shape.

12. The two-member apparatus of claim 10, wherein a back portion of said ornament is soldered onto said second end portion.

13. The two-member apparatus of claim 10, wherein said bent rod-shaped first member and said second member are each made of a material selected from the group consisting of metal, steel, and plastic.

14. A two-member apparatus as defined in claim 10, wherein the edge is an upper edge of a side panel of a bag-like purse.

15. A two-member apparatus as defined in claim 14, wherein the bag-like purse is a purse, a backpack, or a briefcase.

16. A two-member apparatus as defined in claim 10, wherein said bent rod-shaped first member and said second member are configured so that when the bent rod-shaped first member is retrieved from the edge, the second member is necessarily retrieved.

17. A method comprising:

(a) retaining at least one key in a closed-form clasp of a second member of a two-member apparatus, wherein (i) a bent rod-shaped first member of said two-member apparatus has a first end portion and a second end portion, wherein said first end portion and said second end portion are opposed to each other, (ii) said bent rod-shaped first member incorporates a u-shaped region intermediate said first end portion and said second end portion, wherein said first end portion and said second end portion are not urged against each other and are configured to allow said u-shaped region to hang from an upper edge of a side panel of a bag-like purse, (iii) said bent rod-shaped first member and said second member are substantially permanently and flexibly engaged to one another via a single hook at said first end portion of said bent rod-shaped first member, and (iv) an ornament is fixed to said second end portion; and (b) hanging the two-member apparatus from said upper edge of said side panel of said bag-like purse with the u-shaped region overhanging the side panel so that a face of the ornament is exposed, wherein said closed-form clasp is rotatably fixed to a u-shaped element and wherein said u-shaped element engages said single hook, and wherein the ornament provides the function of readily locating the two-member apparatus on the upper edge and wherein the ornament provides the function of an attractive adjunct.

18. The method of claim 17, wherein the bag-like purse is a purse, a backpack, or a briefcase.

19. The method of claim 17, the method further comprising:

c) retrieving said bent rod-shaped first member of said two-member apparatus from said upper edge such that, when said bent rod-shaped first member is retrieved from the upper edge, the at least one key retrained in the closed-form clasp of the second member is necessarily retrieved.

* * * * *